US007909784B2

(12) United States Patent
Kornaker

(10) Patent No.: US 7,909,784 B2
(45) Date of Patent: Mar. 22, 2011

(54) CARDIOPULMONARY ASSIST DEVICE

(76) Inventor: Kathleen M. Kornaker, Strongsville, OH (US)

( * ) Notice: Subject to any disclaimer, the term of this patent is extended or adjusted under 35 U.S.C. 154(b) by 1007 days.

(21) Appl. No.: 11/145,548

(22) Filed: Jun. 3, 2005

(65) Prior Publication Data

US 2006/0272095 A1 Dec. 7, 2006

(51) Int. Cl.
*A61H 31/00* (2006.01)

(52) U.S. Cl. ..... 601/41; 601/44; 482/142

(58) Field of Classification Search ..... 601/107, 601/144, 134, 41–44; 5/632, 633; 482/142, 482/140, 23, 148; 128/870
See application file for complete search history.

(56) References Cited

U.S. PATENT DOCUMENTS 1,848,212 A * 3/1932 Waterman ..... 601/41
2,343,204 A * 2/1944 Paton ..... 482/142
3,804,082 A * 4/1974 Tarjan et al. ..... 601/41
3,870,038 A * 3/1975 Arblaster ..... 601/41
4,230,099 A * 10/1980 Richardson ..... 606/240
4,355,634 A * 10/1982 Kanter ..... 601/41
4,584,729 A * 4/1986 Roberts et al. ..... 5/625
4,949,413 A 8/1990 Goodwin
5,051,673 A 9/1991 Goodwin
D321,402 S * 11/1991 Hoshino ..... D24/188
5,190,056 A * 3/1993 Hull ..... 5/621
5,267,931 A * 12/1993 Faetini ..... 482/140
5,473,784 A * 12/1995 Nixon et al. ..... 5/625
5,487,722 A * 1/1996 Weaver et al. ..... 601/41
5,498,233 A * 3/1996 Stojanovic ..... 602/19
5,568,662 A * 10/1996 Gougelet ..... 5/625
5,570,703 A * 11/1996 Cooper ..... 5/633
5,630,789 A * 5/1997 Schock et al. ..... 601/41
5,645,522 A * 7/1997 Lurie et al. ..... 601/43
5,774,916 A * 7/1998 Kurhi ..... 5/632
5,934,282 A * 8/1999 Young et al. ..... 128/870
6,059,750 A 5/2000 Fogarty et al.
6,066,106 A 5/2000 Sherman et al.
6,090,056 A 7/2000 Bystrom et al.
6,142,962 A 11/2000 Mollenauer et al.
6,398,745 B1 6/2002 Sherman et al.
6,447,465 B1 9/2002 Sherman et al.
6,503,265 B1 1/2003 Fogarty et al.
6,536,056 B1 3/2003 Vrzalik et al.
6,599,258 B1 7/2003 Bystrom et al.
6,616,620 B2 9/2003 Sherman et al.
6,699,259 B2 3/2004 Fogarty et al.
6,709,410 B2 3/2004 Sherman et al.
2002/0156401 A1 10/2002 Sherman et al.
2003/0009115 A1 1/2003 Sherman et al.
2003/0105481 A1 6/2003 Fogarty
2003/0208847 A1 11/2003 Vrzalik et al.
2004/0002667 A1 1/2004 Sherman et al.
2004/0006290 A1 1/2004 Sherman et al.
2004/0030271 A1 2/2004 Sherman et al.
2004/0064054 A1 4/2004 Clift
2004/0073145 A1 4/2004 Bystrom et al.
2004/0167563 A1 8/2004 Fogarty et al.
2004/0193076 A1 9/2004 Sherman et al.
2004/0215112 A1 10/2004 Mollenauer et al.
2004/0225238 A1 11/2004 Sherman et al.

* cited by examiner

*Primary Examiner* — Justine R Yu
*Assistant Examiner* — Valerie Skorupa
(74) *Attorney, Agent, or Firm* — Fay Sharpe LLP

(57) ABSTRACT

The present invention deals with a simple device to aid in cardiac compression to assist in reestablishing normal heart rhythm. The design and size of the device is particularly useful in morbidly obese individuals that require cardiac compressions in order to optimize resuscitation efforts.

13 Claims, 3 Drawing Sheets

CARDIOPULMONARY ASSIST DEVICE

BACKGROUND OF THE INVENTION

1. Field of the Invention

The present invention deals with individuals in need of cardiopulmonary resuscitation (CPR). The present invention provides an effective method of delivering cardiac compression to individuals in need of such treatment.

With the increase in the number of obese people there is a need to develop and utilize new, bigger and better equipment to care for obese patients. Greater numbers of morbidly obese patients are being treated for high blood pressure, diabetes, sleep apnea, and choose bariatric surgery as a means of weight control. Obese patients are at risk for cardiac arrest whether they are medical or surgical patients. Cardiopulmonary resuscitation is an effective way to provide artificial circulatory and ventilatory support. It is difficult to perform effective chest compressions on a morbidly obese patient due to excess adipose. The present invention, a cardiopulmonary resuscitation assist device is designed to support the spine and upper thorax in order to improve the effectiveness of chest compression in the event of a cardiac arrest in an obese patient.

2. Description of the Art Practices

U.S. Pat. No. 6,709,410 Sherman, et al., Mar. 23, 2004 describes a system for performing chest compression for cardiopulmonary resuscitation. The system includes a motor, drive spool and associated couplings which allow for controlling and limiting the movement of the compressing mechanism and includes a control system for controlling the operation and interaction of the various components to provide for optimal automatic operation of the system.

U.S. Pat. No. 6,699,259 issued to Fogarty, et al., Mar. 2, 2004 suggests a minimally invasive device for performing direct cardiac massage including an inflatable bladder mounted on a rigid inflation tube. The rigid inflation tube is used to push the bladder into the sternocostal space through an incision in the upper abdomen just below the xiphoid process. A tear-away insertion sleeve is provided over the balloon, so that the device may easily be inserted in to the body. The insertion sleeve includes various features that assist in placement of the device and removal of the sleeve. After insertion into the sternocostal space and removal of the insertion sleeve, the bladder is repeatedly inflated and deflated to massage the heart and provide blood flow.

U.S. Pat. No. 6,616,620 issued to Sherman, et al., Sep. 9, 2003 describes a resuscitation device for automatic compression of a victim's chest using a compression belt, which exerts force evenly over the entire thoracic cavity. The belt is constricted and relaxed through a motorized spool assembly that repeatedly tightens the belt and relaxes the belt to provide repeated and rapid chest compression.

U.S. Pat. No. 6,447,465 issued to Sherman, et al., Sep. 10, 2002 suggests system for performing chest compression and abdominal compression for cardiopulmonary resuscitation. The system includes a motor and gearbox including a system of clutches and brakes which allow for controlling and limiting the movement of compressing mechanisms operating on the chest and the abdomen of a patient U.S. Pat. No. 6,503,265 issued to Fogarty, et al., Jan. 7, 2003 recites a minimally invasive device for performing direct cardiac massage including an inflatable bladder mounted on a rigid inflation tube. The rigid inflation tube is used to push the bladder into the sternocostal space through an incision in the upper abdomen just below the xiphoid process. After insertion into the sternocostal space, the bladder is repeatedly inflated and deflated to massage the heart and provide blood flow.

U.S. Pat. No. 6,536,056 issued to Vrzalik, et al., Mar. 25, 2003 suggests a bariatric treatment system providing a comprehensive array of therapeutic services for the morbidly obese patient. The treatment system generally comprises a stable bed frame upon which is mounted a low air loss therapeutic mattress system. Integrated hardware and software controls provide such therapies as pulsation, percussion, rotation, cardiac chair and Trendelenburg. Means are disclosed whereby the bariatric patient may safely and comfortably enter and exit the bed with relative ease. The bed is adaptable for transport within a hospital, including such features as a transport mode wherein the bed's lateral axis is minimized and battery backup to maintain necessary therapies during patient transport. A plurality of control means are disclosed for simplification of caregiver workload and ease of patient utilization.

U.S. Pat. No. 6,599,258 issued to Bystrom, et al., Jul. 29, 2003 sets out a resuscitation device for automatic compression of victim's chest using a compression belt that exerts force evenly over the entire thoracic cavity. The belt is constricted and relaxed through a motorized spool assembly that repeatedly tightens the belt and relaxes the belt to provide repeated and rapid chest compression. An assembly includes various resuscitation devices including chest compression devices, defibrillation devices, and airway management devices, along with communications devices and senses with initiate communications with emergency medical personnel automatically upon use of the device.

U.S. Pat. No. 6,699,259 issued to Fogarty, et al., Mar. 2, 2004 describes a minimally invasive device for performing direct cardiac massage including an inflatable bladder mounted on a rigid inflation tube. The rigid inflation tube is used to push the bladder into the sternocostal space through an incision in the upper abdomen just below the xiphoid process. A tear-away insertion sleeve is provided over the balloon, so that the device may easily be inserted in to the body. The insertion sleeve includes various features that assist in placement of the device and removal of the sleeve. After insertion into the sternocostal space and removal of the insertion sleeve, the bladder is repeatedly inflated and deflated to massage the heart and provide blood flow.

United States Published Patent Application 20020156401 to Sherman et al., dated Oct. 24, 2002 suggests a system for performing chest compression for cardiopulmonary resuscitation. The system includes a motor, drive spool and associated couplings that allow for controlling and limiting the movement of the compressing mechanism and includes a control system for controlling the operation and interaction of the various components to provide for optimal automatic operation of the system.

United States Published Patent Application 20030009115 to Sherman et al., dated Jan. 9, 2003 sets out a system for performing chest compression and abdominal compression for cardiopulmonary resuscitation. The system includes a motor and gearbox including a system of clutches and brakes which allow for controlling and limiting the movement of compressing mechanisms operating on the chest and the abdomen of a patient.

United States Published Patent Application 20030105481 to Fogarty, et al., and dated Jun. 5, 2003 sets out a minimally invasive device for performing direct cardiac massage including an inflatable bladder mounted on a rigid inflation tube. The rigid inflation tube is used to push the bladder into the sternocostal space through an incision in the upper abdomen just below the xiphoid process. A tear-away insertion sleeve is provided over the balloon, so that the device may easily be inserted in to the body. The insertion sleeve includes various features that assist in placement of the device and removal of the sleeve. After insertion into the sternocostal space and removal of the insertion sleeve, the bladder is repeatedly inflated and deflated to massage the heart and provide blood flow.

United States Published Patent Application 20030208847 to Vrzalik, et al., dated Nov. 13, 2003 postulates a bariatric treatment system providing a comprehensive array of therapeutic services for the morbidly obese patient is disclosed. The treatment system generally comprises a stable bed frame upon which is mounted a low air loss therapeutic mattress system. Integrated hardware and software controls provide such therapies as pulsation, percussion, rotation, cardiac chair and Trendelenburg. Means are disclosed whereby the bariatric patient may safely and comfortably enter and exit the bed with relative ease. The bed is adaptable for transport within a hospital, including such features as a transport mode wherein the bed's lateral axis is minimized and battery backup to maintain necessary therapies during patient transport. A plurality of control means are disclosed for simplification of caregiver workload and ease of patient utilization.

United States Published Patent Application 20040002667 to Sherman, et al., dated Jan. 1, 2004 recites a resuscitation device for automatic compression of a victim's chest using a compression belt which exerts force evenly over the entire thoracic cavity. The belt is constricted and relaxed through a motorized spool assembly that repeatedly tightens the belt and relaxes the belt to provide repeated and rapid chest compression.

United States Published Patent Application 20040006290 to Sherman, et al., dated Jan. 8, 2004 suggests a resuscitation device for automatic compression of a victim's chest using a compression belt which exerts force evenly over the entire thoracic cavity. The belt is constricted and relaxed through a motorized spool assembly that repeatedly tightens the belt and relaxes the belt to provide repeated and rapid chest compression.

United States Published Patent Application 20040030271 to Sherman, et al., and dated Feb. 12, 2004 provides a resuscitation device for automatic compression of a victim's chest using a compression belt, which exerts force evenly over the entire thoracic cavity. The belt is constricted and relaxed through a motorized spool assembly that repeatedly tightens the belt and relaxes the belt to provide repeated and rapid chest compression.

United States Published Patent Application 20040064054 to Clift dated Apr. 1, 2004 recites an apparatus and techniques are provided for precise measuring and monitoring of certain vital signs of patients that have been difficult to measure especially in emergency situations. A sensor may be used for detecting contraction and expansion in the vascular bed of the lining tissue of the external auditory canal during a cardiac cycle to obtain a better indication of certain physiological parameters. Such a signal generally may be superimposed with an additional signal that is primarily due to breathing activity of the patient. Based on various scenarios different sensors may be used to determine the signal due to breathing activity and thus the physiological parameter of interest may be derived. The signal corresponding to the physiological parameter of interest, for example, blood pressure may then be used to monitor the vital signs or control other medical equipment.

United States Published Patent Application 20040073145 to Bystrom dated Apr. 15, 2004 describes a resuscitation device for automatic compression of victim's chest using a compression belt, which exerts force evenly over the entire thoracic cavity. The belt is constricted and relaxed through a motorized spool assembly that repeatedly tightens the belt and relaxes the belt to provide repeated and rapid chest compression. An assembly includes various resuscitation devices including chest compression devices, defibrillation devices, and airway management devices, along with communications devices and senses with initiate communications with emergency medical personnel automatically upon use of the device.

United States Published Patent Application 20040167563 to Fogarty, et al., dated Aug. 26, 2004 suggests a minimally invasive device for performing direct cardiac massage including an inflatable bladder mounted on a rigid inflation tube. The rigid inflation tube is used to push the bladder into the sternocostal space through an incision in the upper abdomen just below the xiphoid process. A tear-away insertion sleeve is provided over the balloon, so that the device may easily be inserted in to the body. The insertion sleeve includes various features that assist in placement of the device and removal of the sleeve. After insertion into the sternocostal space and removal of the insertion sleeve, the bladder is repeatedly inflated and deflated to massage the heart and provide blood flow.

United States Published Patent Application 20040193076 to Sherman, et al., and dated Sep. 30, 2004 describes a system for performing chest compression for cardiopulmonary resuscitation. The system includes a motor, drive spool and associated couplings, which allow for controlling and limiting the movement of the compressing mechanism and includes a control system for controlling the operation and interaction of the various components to provide for optimal automatic operation of the system.

United States Published Patent Application 20040215112 to Mollenauer et al., dated Oct. 28, 2004 suggests a resuscitation device for automatic compression of victim's chest using a compression belt, which exerts force evenly over the entire thoracic cavity. The belt is constricted and relaxed through a motorized spool assembly that repeatedly tightens the belt and relaxes the belt to provide repeated and rapid chest compression. An assembly includes various resuscitation devices including chest compression devices, defibrillation devices, and airway management devices, along with communications devices and senses with initiate communications with emergency medical personnel automatically upon use of the device United States Published Patent Application 20040225238 to Sherman, et al., and dated Nov. 11, 2004 recites a resuscitation device for automatic compression of a victim's chest using a compression belt operably attached to a platform upon which a patient rests. In use, the compression belt is wrapped around the patient and at least one spindle operably attached to the platform.

The foregoing devices are difficult to employ, often involve invasive procedures, and when cardio-version (electric shock) is utilized must be disconnected to prevent damage to the equipment.

To the extent that the foregoing patents and references are relevant to the present invention they are herein incorporated by reference.

SUMMARY OF THE INVENTION

The present invention describes a cardiopulmonary assist device comprising:

a generally rectangular object;

said generally rectangular object having a first generally rectangular flat surface;

said generally rectangular object having a first side area;

said generally rectangular object having a second side area;

said generally rectangular object having a first end region;

said generally rectangular object having a second end region;

said generally rectangular object having a second generally rectangular surface;

said generally rectangular object having a second generally rectangular surface having a raised region thereon a centrally located between the first side area and the second side area.

The present invention describes also describes a cardiopulmonary assist device comprising:

a generally rectangular object;

said generally rectangular object having a first generally rectangular flat surface;

said generally rectangular object having a first side area;

said generally rectangular object having a second side area;

said generally rectangular object having a first end region;

said generally rectangular object having a second end region;

said generally rectangular object having a second generally rectangular surface;

said generally rectangular object having a second generally rectangular surface having a raised region thereon a centrally located between the first side area and the second side area;

provided further that the raised region is generally trapezoidal configuration having a trapezoidal base region, a trapezoidal region upper region, a first trapezoidal side and a second trapezoidal side, and;

wherein the generally trapezoidal configuration does not extend to one of the first side area or the second side area.

Another aspect of the invention is a method of treating a mammalian subject in need of cardiopulmonary resuscitation comprising placing the mammalian subject in a supine position on a cardiopulmonary assist device having a raised region, such that the cardio-region of the mammalian subject is located above the raised region during at least a portion of the time that cardiopulmonary resuscitation is performed on the mammalian subject.

BRIEF DESCRIPTION OF THE DRAWINGS

The features of the present invention will become apparent to one skilled in the art to which the present invention relates upon consideration of the following description of the invention with reference to the accompanying drawings, wherein.

DETAILED DESCRIPTION OF THE INVENTION

Figure 1:
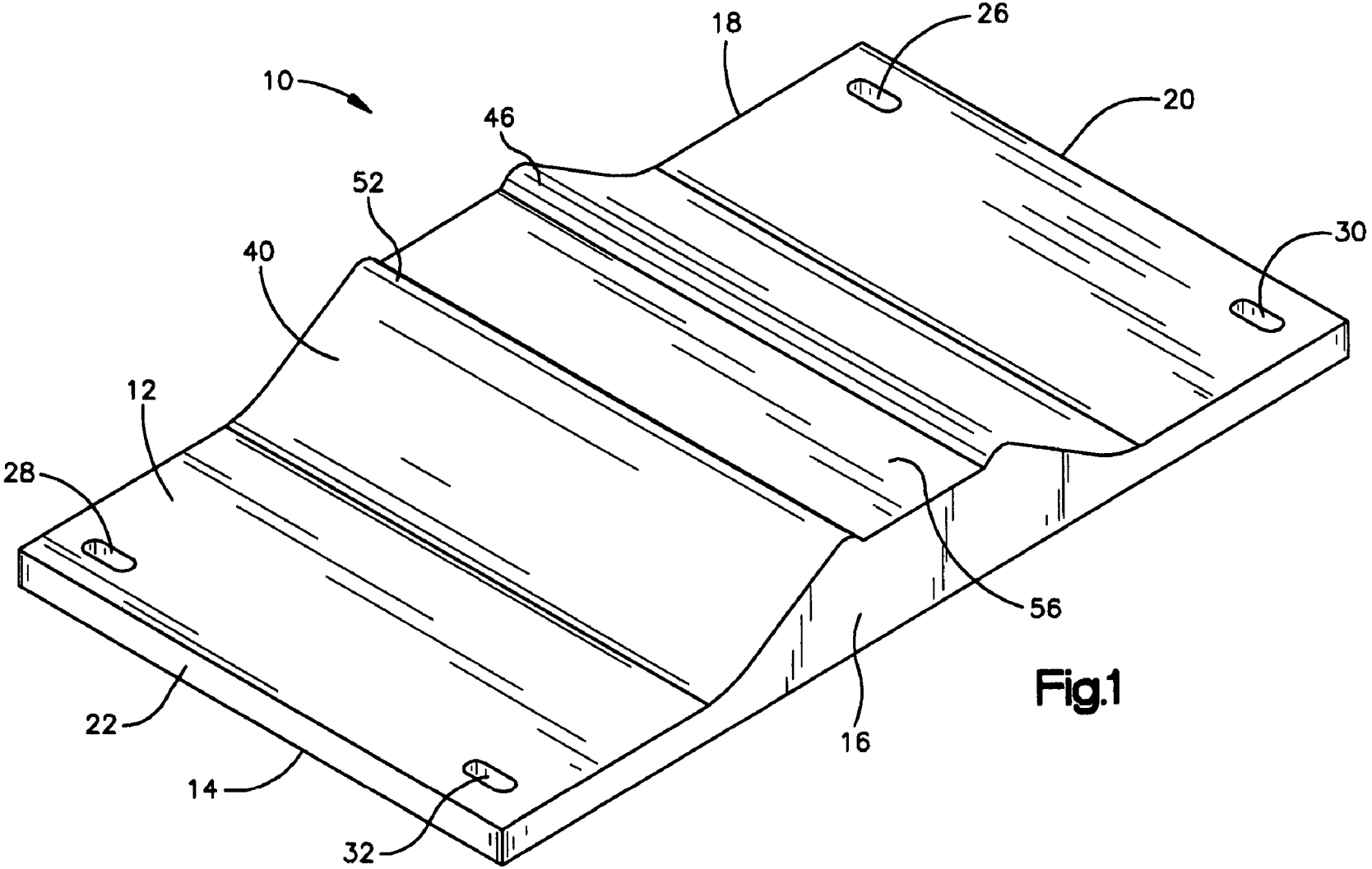
FIG. 1 is a perspective view according to the present invention.

As best seen in FIG. 1 is a cardiopulmonary resuscitation assist device 10. The cardiopulmonary resuscitation assist device 10 has a cardiopulmonary resuscitation assist device upper surface 12. The cardiopulmonary resuscitation assist device 10 also has a cardiopulmonary resuscitation assist device lower surface 14. A cardiopulmonary resuscitation assist device lower end 16 is located between the cardiopulmonary resuscitation assist device upper surface 12 and the cardiopulmonary resuscitation assist device lower surface 14.

A cardiopulmonary resuscitation assist device upper end 18 is located in between the cardiopulmonary resuscitation assist device upper surface 12 and the cardiopulmonary resuscitation assist device lower surface 14. The cardiopulmonary resuscitation assist device 10 has a cardiopulmonary resuscitation assist device first side 20. The cardiopulmonary resuscitation assist device 10 also has a cardiopulmonary resuscitation assist device second side 22.

The cardiopulmonary resuscitation assist device 10 is generally rectangular. The cardiopulmonary resuscitation assist device 10 is symmetrical on the cardiopulmonary resuscitation assist device upper surface 12. The cardiopulmonary resuscitation assist device 10 is also symmetrical on the cardiopulmonary resuscitation assist device lower surface 14.

The cardiopulmonary resuscitation assist device 10 may be conveniently formed from one or more materials. As a practical matter it is preferred that the cardiopulmonary resuscitation assist device 10 be formed from a single material such as a plastic. Such formation of the cardiopulmonary resuscitation assist device 10 may be accomplished by injection molding. The cardiopulmonary resuscitation assist device 10 is generally formed such that it is a non-resilient. Conveniently, the cardiopulmonary resuscitation assist device 10 is electrically non-conductive.

The cardiopulmonary resuscitation assist device 10 has a cardiopulmonary resuscitation assist device first handgrip 26 along the cardiopulmonary resuscitation assist device first side 20. The cardiopulmonary resuscitation assist device 10 has a cardiopulmonary resuscitation assist device second handgrip 28 along the cardiopulmonary resuscitation assist device second side 22. The cardiopulmonary resuscitation assist device 10 has a cardiopulmonary resuscitation assist device third handgrip 30 located along the cardiopulmonary resuscitation assist device first side 20. The cardiopulmonary resuscitation assist device 10 has a cardiopulmonary resuscitation assist device fourth handgrip 32 located along the cardiopulmonary resuscitation assist device second side 22. The various handgrips extend through the cardiopulmonary resuscitation assist device upper surface 12 to the cardiopulmonary resuscitation assist device lower surface 14.

The various handgrips are of a sufficient size to permit movement of the cardiopulmonary resuscitation assist device 10 beneath an obese patient as later described. The handgrips are intended as a matter of convenience and are not required for the cardiopulmonary resuscitation assist device 10 to function.

Extending from the cardiopulmonary resuscitation assist device upper surface 12 of the cardiopulmonary resuscitation assist device 10 is a cardiopulmonary resuscitation assist device raised region 40. The cardiopulmonary resuscitation assist device raised region 40 has a cardiopulmonary resuscitation assist device raised region first ridge 46. The cardiopulmonary resuscitation assist device raised region 40 also has a cardiopulmonary resuscitation assist device raised region second ridge 52. Located between the cardiopulmonary resuscitation assist device raised region first ridge 46 and the cardiopulmonary resuscitation assist device raised region second ridge 52 is a cardiopulmonary resuscitation assist device trough 56.

Figure 2:
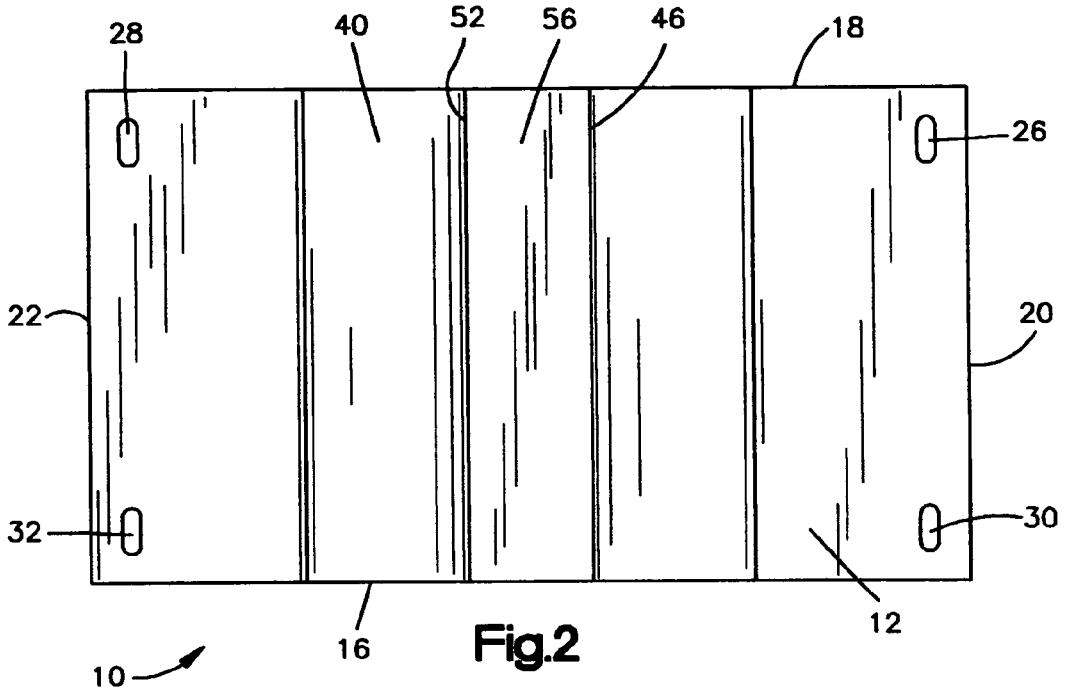
FIG. 2 is a plan view according to the present invention.
Figure 3:
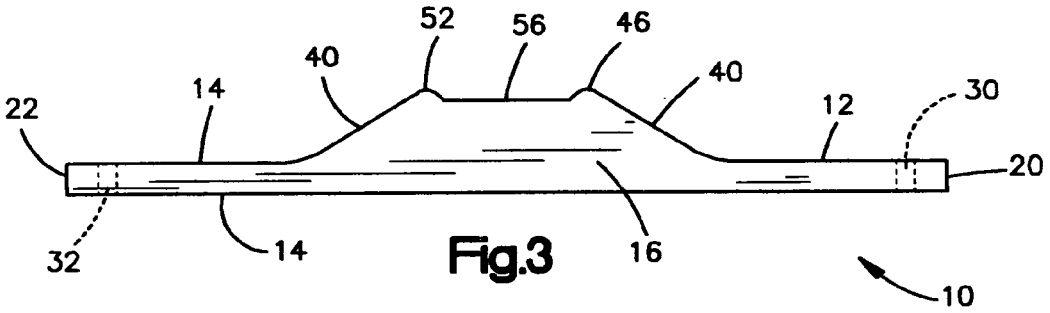
FIG. 3 is an end view according to the present invention.
Figure 4:
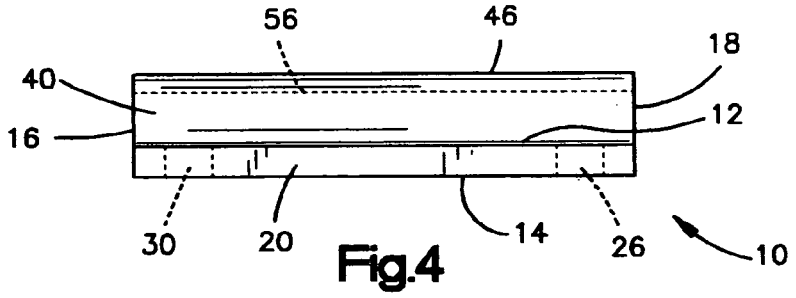
FIG. 4 is a first side view according to the present invention.

As best seen in FIG. 2, the cardiopulmonary resuscitation assist device raised region 40 is devised such that when an obese patient may be placed on the cardiopulmonary resuscitation assist device 10. The cardiopulmonary resuscitation assist device trough 56 is thus of a sufficient width to accommodate the obese patient. A space of several inches exists for the cardiopulmonary resuscitation assist device trough 56 between the cardiopulmonary resuscitation assist device raised region first ridge 46 and cardiopulmonary resuscitation assist device raised region second ridge 52. The distance between cardiopulmonary resuscitation assist device raised region first ridge 46 and cardiopulmonary resuscitation assist device raised region second ridge 52 is such that the scapulae of a patient placed on the cardiopulmonary resuscitation assist device raised region 40 are located outward of the respective cardiopulmonary resuscitation assist device raised region ridges 46 and 52.

The cardiopulmonary resuscitation assist device raised region first ridge 46 and the cardiopulmonary resuscitation assist device raised region second ridge 52 are generally rounded to avoid injury to an obese patient positioned on the cardiopulmonary resuscitation assist device 10. The size of the cardiopulmonary resuscitation assist device 10 is conveniently 28 inches by 16 inches. The height of the cardiopulmonary resuscitation assist device raised region first ridge 46 from the cardiopulmonary resuscitation assist device lower surface 14 is about 1.5 to about 6 times the distance from the cardiopulmonary resuscitation assist device lower surface 14 to the cardiopulmonary resuscitation assist device trough 56.

Figure 5:
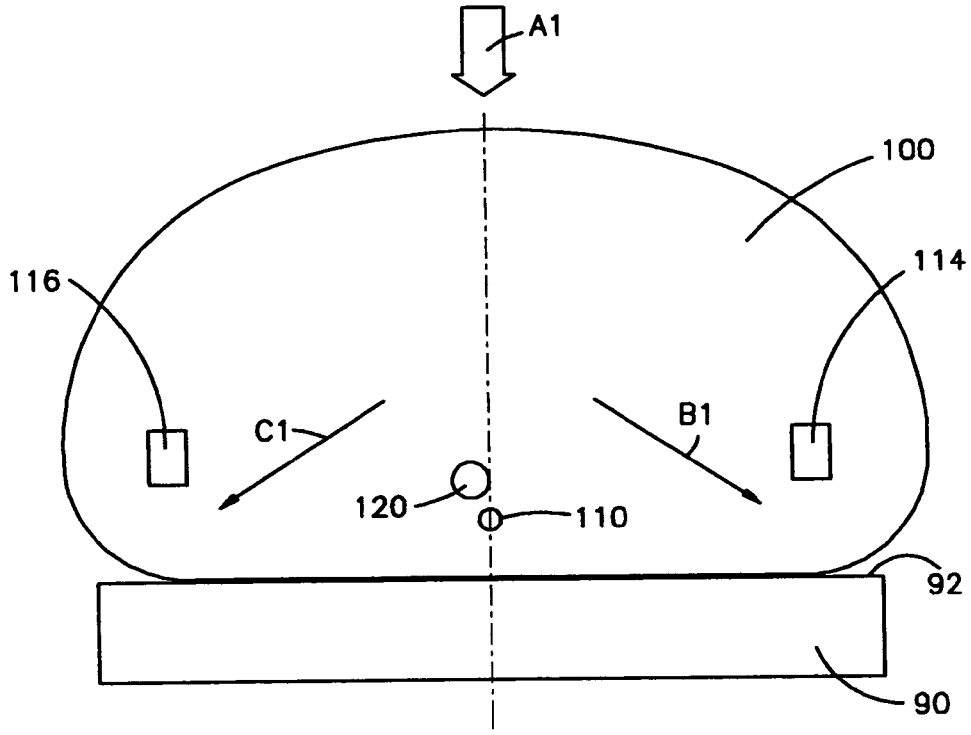
Fig.5 PRIOR ART
FIG. 5 is a prior art device.

As best seen in FIG. 5 is a prior art board 90. The prior art board 90 has a flat surface 92. The prior art board 90 may simply be a piece of plywood in a rectangular shape.

A patient 100 is shown positioned on the prior art board 90. The patient 100 has a patient spinal column 110. The patient also has a scapula 114 and a scapula 116. The patient 100 has a heart 120.

Cardiac and respiratory arrest is a risk for obese patients. When a patient undergoes cardiac arrest cardiopulmonary resuscitation is performed. The cardiopulmonary resuscitation involves as one aspect the compression of the heart region to provide blood flow through the body of cardiac arrest patient. The morbidly obese present great difficulty in receiving cardiac compression. The difficulty arises because the morbidly obese have an excess of adipose tissue that deflects and absorbs the force delivered by the person performing the cardiac compression.

A best seen in FIG. 5 the patient 100 will receive a force A 1 applied manually to provide the cardiac compression portion of cardiopulmonary resuscitation. The force A 1 is applied directly over the patient heart 120 of the patient 100. As the prior art board 90 has a flat surface 92 there is nothing to stop the force A 1 from the urging toward the force lines B 1 and C 1. That is, the large amounts of adipose tissue in the patient permit deflection and absorption of the force A 1 such that heart is not effectively compressed.

Accordingly, the patient 100 loses most of the force A 1 applied to the patient heart 120 of the patient 100. The same situation occurs when any flat surface is utilized to perform cardiopulmonary resuscitation.

Figure 6:
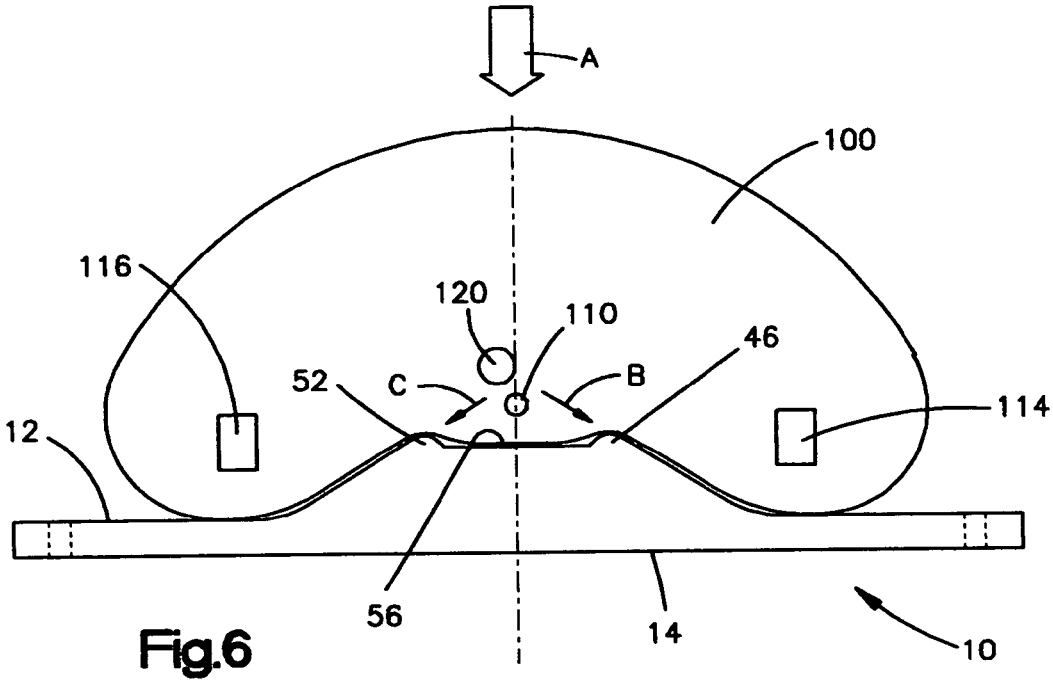
FIG. 6 is a schematic view according to the present invention.

As seen in FIG. 6 a patient 100 has the cardiopulmonary resuscitation assist device 10 positioned such that the patient's heart 120 is between the cardiopulmonary resuscitation assist device raised region second ridge 52 and the cardiopulmonary resuscitation assist device trough 56. When the force A is applied to the cardiac region of the patient 100 positioned on the cardiopulmonary resuscitation assist device 10 the deflection of the force A in the direction of B and C is considerably less as the adipose tissue is less inclined to move freely.

The effect of the present invention is to permit the force to be applied effectively to the patient's heart 120 without undue deflection or absorption of the force by the adipose tissue of the patient 100.

From the above description of the invention, those skilled in the art will perceive improvements, changes and modifications. Such improvements, changes and modifications within the skill of the art are intended to be covered by the appended claims.

What is claimed is:

1. A cardiopulmonary assist device comprising:

a body having a first generally rectangular flat surface extending along a longitudinal axis of said body;

a first side area;

a second side area;

a first end region;

a second end region;

a second generally rectangular flat surface substantially parallel to said first flat surface having a first raised region comprising a first sloped surface and a first ridge and a second raised region comprising a second sloped surface and a second ridge and a third flat surface formed between said first and second raised regions which spaces said first and second raised regions apart and extends completely between said first and second ridges, wherein said first and second ridges terminate in said third flat surface, said third flat surface being parallel to and spaced apart from said second rectangular flat surface; wherein said body is of a width to accommodate an obese person; and, wherein said cardiopulmonary assist device is a unitary injection molded object.

2. The cardiopulmonary assist device according to claim 1, having at least one elongated opening formed on each of opposite sides of said device, for when in use, to permit a hand grasping action in said openings.

3. A method of treating a mammalian subject in need of cardiopulmonary resuscitation comprising placing the mammalian subject in a supine position on a cardiopulmonary assist device according to claim 1, such that the cardio-region of the mammalian subject is located above the first and second raised regions during at least a portion of the time that cardiopulmonary resuscitation is performed on the mammalian subject, and performing cardiopulmonary resuscitation on the mammalian subject.

4. The cardiopulmonary assist device of claim 1, wherein said first sloped surface extends between said second generally rectangular flat surface and said first ridge.

5. The cardiopulmonary assist device of claim 4, wherein said second sloped surface extends between said second generally rectangular surface and said second ridge.

6. A cardiopulmonary assist device comprising:

a body comprising:

a first generally rectangular flat surface;

a first side area;

a second side area;

a first end region;

a second end region;

a second generally rectangular flat surface substantially parallel to said first flat surface and having a raised region thereon centrally located between the first side area and the second side area;

wherein said raised region has a generally trapezoidal configuration having a pair of opposed sloped surfaces and a third flat surface formed between said opposed sloped surfaces wherein said sloped surfaces are spaced apart by said third flat surface, said third flat surface is parallel to and spaced apart from said first end region and said second end region along a length of said body.

7. The cardiopulmonary assist device according to claim 6, wherein said raised region has a first ridge, a second ridge, and said third flat surface forms a trough located between said first ridge and said second ridge.

8. The cardiopulmonary assist device according to claim 6, which is a unitary injection molded object.

9. The cardiopulmonary assist device according to claim 8, which is a non-resilient material.

10. The cardiopulmonary assist device according to claim 6, having one or more openings, for when in use, to permit a hand grasping action in at least one opening.

11. A method of treating a mammalian subject in need of cardiopulmonary resuscitation comprising placing the mammalian subject in a supine position on a cardiopulmonary assist device according to claim 6, such that the cardio-region of the mammalian subject is located above the raised region during at least a portion of the time that cardiopulmonary resuscitation is performed on the mammalian subject, and performing cardiopulmonary resuscitation on the mammalian subject.

12. A cardiopulmonary assist device comprising:

a generally rectangular object comprising;

a first generally rectangular flat surface;

a first side area of a first length;

a second side area of a second length;

a first end region of a third length;

a second end region of a fourth length;

a second generally rectangular flat surface parallel to said first flat surface;

said second generally rectangular flat surface having a raised region thereon located between the first side area and the second side area and between said first end region and said second end region wherein said raised region comprises a pair of ridges and a third flat surface formed between said ridges which has opposed ends connected to one of each of said ridges and forms a gap between said ridges, wherein said third flat surface is parallel to and is spaced apart from said first end region and said second end region;

said first length and said second length each being greater than said third length and said fourth length; and a pair of openings formed through said first generally rectangular flat surface along said first length and a pair of openings extends through said first generally rectangular flat surface along said second length.

13. The cardiopulmonary assist device of claim 12, wherein said cardiopulmonary assist device is an injection molded object.

* * * * *